United States Patent [19]

Grearson

[11] 3,974,608

[45] Aug. 17, 1976

[54] PANEL WALL CONSTRUCTION

[75] Inventor: Kenneth R. Grearson, Park Ridge, Ill.

[73] Assignee: Multuloc Corporation, Chicago, Ill.

[22] Filed: Oct. 23, 1975

[21] Appl. No.: 625,147

[52] U.S. Cl. ..... 52/235; 52/282; 52/463; 52/476; 52/495

[51] Int. Cl.[2] ..... E04B 2/38

[58] Field of Search ..... 52/235, 280, 282, 284, 52/461, 463, 466, 479, 480, 495

[56] References Cited

UNITED STATES PATENTS

| | | | |
|---|---|---|---|
| 1,865,131 | 6/1932 | Olsen | 52/495 X |
| 2,013,762 | 9/1935 | Olsen | 52/495 X |
| 2,101,952 | 12/1937 | Olsen | 52/349 X |
| 3,034,609 | 5/1962 | Young | 52/461 X |
| 3,076,535 | 2/1963 | Hagerty et al. | 52/461 X |
| 3,429,090 | 2/1969 | Meletnick | 52/476 |
| 3,457,698 | 7/1969 | Albers | 52/495 |
| 3,553,915 | 1/1971 | Passovoy | 52/241 |
| 3,561,182 | 2/1971 | Madl, Jr. | 52/487 |
| 3,732,659 | 5/1973 | La Barge | 52/461 |

FOREIGN PATENTS OR APPLICATIONS

| | | | |
|---|---|---|---|
| 1,447,663 | 6/1966 | France | 52/495 |

*Primary Examiner*—Alfred C. Perham
*Attorney, Agent, or Firm*—Thomas W. Speckman

[57] ABSTRACT

A panel wall construction using box-tee sheet metal shapes wherein the panels may be inserted in channels of the sheet metal shape or clips may be inserted in slots between the channels of the sheet metal shapes to hold the panels. These same shapes may be used for mullions, base sills and top caps thereby producing a panel wall system wherein no screw-type fasteners are required to hold the panels in place. The disclosed panel wall construction provides a very light weight construction which has great flexibility with respect to panel thickness and width as well as great flexibility of design to accommodate wind loadings.

14 Claims, 10 Drawing Figures

21
189
190
191
188
170
40
160
170
20

PANEL WALL CONSTRUCTION

This invention relates to exterior wall construction of the type utilizing wall panels carried by spaced mullions. More particularly, the panel wall construction of this invention relates to the utilization of sheet metal shapes which are readily fabricated by roll forming having at one end a generally hollow box shaped section, one of the sides of the box shape being split in approximately its mid-portion and having opposing legs extending at approximately right angles to the split box wall for a distance suitable to carry a desired panel width, each of the opposing legs then turning approximately 90° to form flanges extending in opposite directions from each leg and approximately parallel to the split box walls. Various types of clips may be inserted between the opposing legs and extend in a locking manner into the interior of the open box section for securely fastening panels between such clips and the surfaces of the flanges away from the box portion of the sheet metal shape. It is a feature of this invention that the entire panel wall may be contructed without the need for conventional fastening means such as screws, bolts and rivets to secure the panels thereby permitting rapid and efficient on-the-site erection. It is a feature of this invention that the same type of sheet metal structural shape may be used as a bottom sill, top cap, vertical mullion, corner assembly, and horizontal joint assembly, thereby locking intervening panels and structural shapes into a solid assembly. The panels, interior and exterior, as well as adjacent panels of differing thickness including glass, may be readily erected with no conventional fasteners being required. The wall construction of this invention presents great flexibility with respect to both vertical and Horizontal spans, differing module dimensions, ease of erection and ease of removal of the structure including damaged panel replacement.

Prior attempts have been made to provide wall systems which do not require screw-type fasteners for holding panels in place. Some such systems are illustrated by U.S. Pat. Nos. 3,732,659, 3,339,329, 3,553,915 and 3,418,772. However, such prior methods of wall construction did not have sufficient versatility to provide the desired flexibility of construction of various wall systems. For example, prior wall systems have required different structural shapes for the bottom sills, top caps and for the mullions. Prior conventional wall construction has necessitated the erection of a steel support framework with intermediate girts and their associated hanger rods to prevent excess deflection and sub-girts followed by panel attachment. Conventional wall construction requires scaffolding to fasten the wall panels to the mullions and sub-girts. The wall construction of this invention may eliminate sub-girts, the sheet metal shape being the load carrying element. In prior building walls, the wind loading, both positive and negative, is accommodated by backinng the panels with sub-girts and like structures, the resistance to negative loading frequently being limited to screw-type fasteners.

It is an object of this invention to overcome many of the disadvantages of prior art wall construction.

It is another object of this invention to provide a panel wall construction which eliminates the necessity for screw-type fastenings in its erection.

It is still another object of this invention to provide a panel wall construction which has high resistance to both positive and negative wind loading forces.

It is another object of this invention to provide a panel wall construction wherein. adjacent panels may be of widely varying thicknesses.

It is yet another object of this invention to provide a panel wall system utilizing roll formed sheet metal structural shapes wherein the same type of structural shape is used for upper caps, lower sills and mullions.

These and other objects of the invention which will become apparent upon reading the following description and by reference to the drawings wherein.

Figure 1:
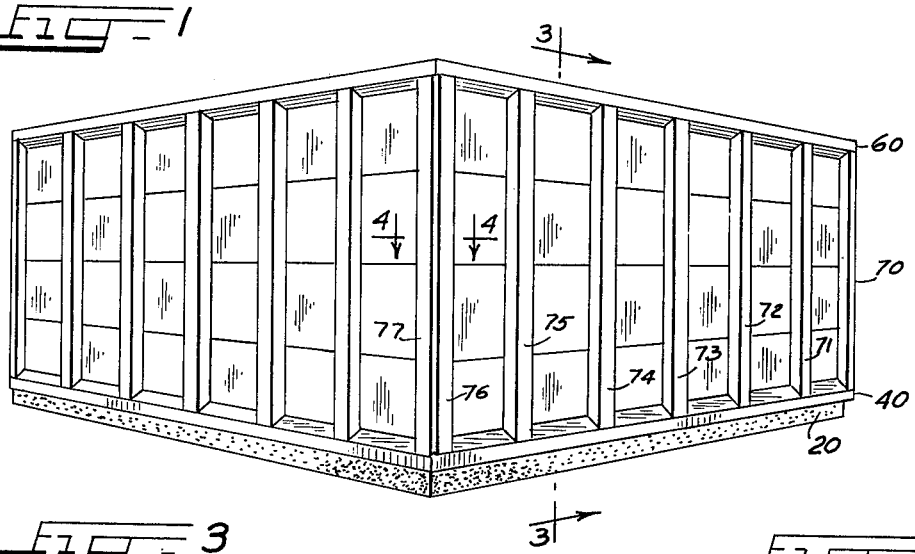
FIG. 1 is an exterior perspective view of the corner of the exterior wall of a building utilizing one embodiment of this invention.

FIGS. 1 through 4 show one wall system according to this invention. From FIG. 1 it is seen that the box portion of the sheet metal shape 40 is exposed to the exterior of the wall while the panels are toward the interior. The wall structure of FIG. 1 uses the same roll formed sheet metal shape 40, best seen in FIG. 3, as a lower sill attached to foundation 20, as vertical mullions 70 through 77 and as top cap 60 with panels 80 forming the wall closure. The wall construction as shown in FIGS. 1 through 4 does not have any interior framework such as sub-girts, but only requires a structural framework at the top and bottom of the wall. FIG. 1 shows a wall having four panels in height. It is one feature of this invention that the entire height may be spanned by one panel or as many panels as desired to obtain desired color or architectural effect.

Figure 3:
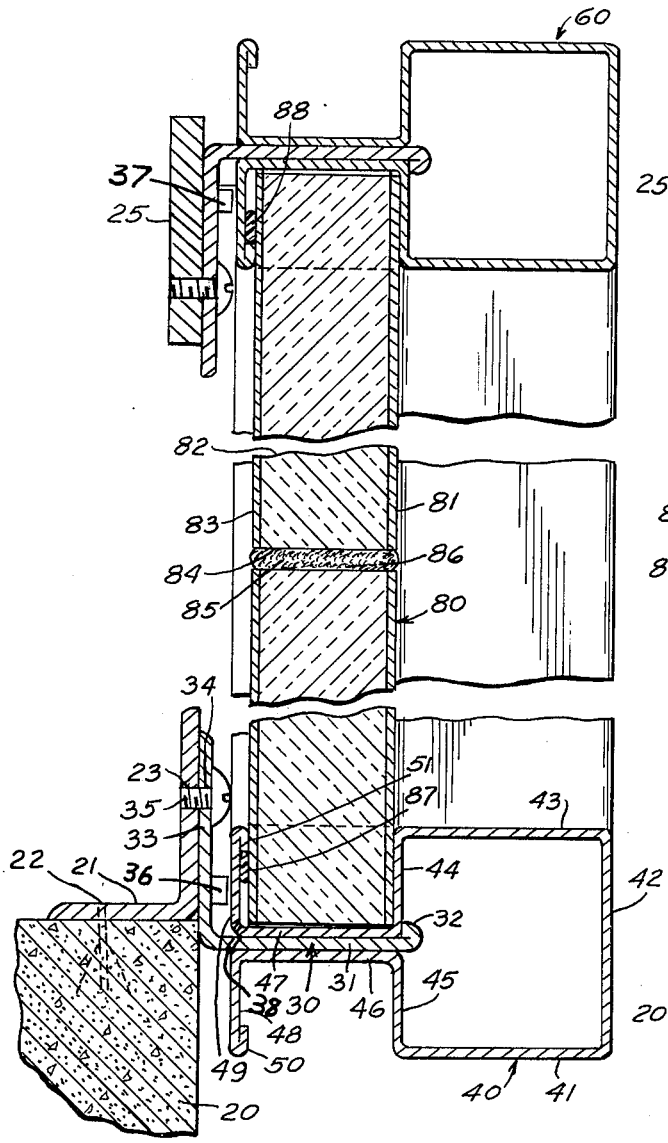
FIG. 3 is a cross section of a portion of the structure as indicated in FIG. 1.

FIG. 3 shows the mounting of the wall system of this invention to the structural framework of the building at the bottom and top. The sheet metal structural box tee shape is shown as 40 having three adjacent box walls 41, 42, and 43 with the fourth box wall being split into two equal segments 44 and 45. From the ends of the split box walls 44 and 45, opposing legs 47 and 46 extend away from the box section at about 90° for a distance sufficient to accommodate the width of the desired panel 80. At their outer ends, opposing legs 46 and 47 are bent to extend away from each other at approximately 90° forming flanges 48 and 49, respectively. The ends of flanges 48 and 49 may be turned inwardly back upon themselves forming flange end turnback 50 and 51 to stiffen the edges of the flanges and to provide a smooth contact surface for the panels which may impart some spring action to the flanges when the panels are inserted.

FIG. 3 shows foundation 20 having foundation angle 21 mounted along its upper outer edge by foundation angle fastening 22. The vertical leg of foundation angle 21 may extend upward or downward as desired. As shown in FIG. 3, the foundation angle extends upwardly from the concrete foundation and may have fastening hole 23 for acceptance of clip fastener 35. Clip 30 may be welded, screwed or power fastened to foundation angle 21. Clip 30 and its manner of use is one important feature of this invention. As is seen in FIG. 3, clip 30 has body portion 31 with the end of the body portion forming locking end 32 by being turned over upon itself. The opposite end of body portion 31 has clip leg 33 at right angles to the body portion. clip leg 33 may have clip fastener hole 34 through which clip fastener 35 may hold sheet metal clip 30 to foundation angle 21.

The top of the wall as shown in FIGS. 1-4 is fastened to structural frame 25 in a similar manner as described above for the bottom sill. Sheet metal structural shape 60 is installed over the top of panel 80 as a top cap and fastened to the structural frame.

Figure 2:
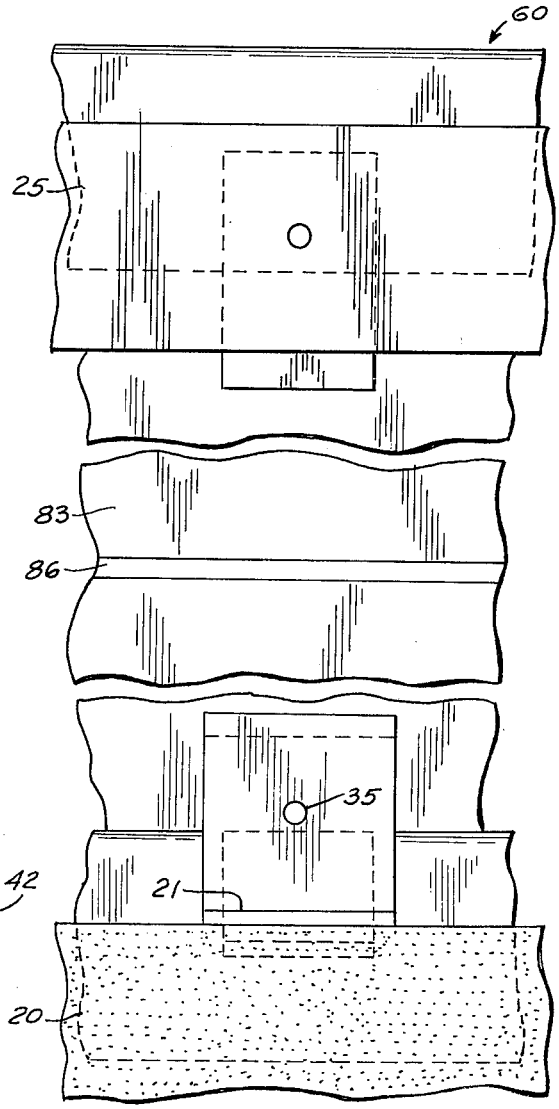
FIG. 2 is a side view of the upper cap and lower sill as viewed from the outside of the structure at right angles to the section shown in FIG. 3.

The wall construction according to this invention is very light weight with the gravity load of the wall being carried by clips 30. As shown in FIG. 2, clips 30 are not continuous but may be of any desired length necessary for the support of the wall. Sufficient clips installed to carry the desired wall load. Both vertical and horizontal alignment of the bottom of the wall according to this invention are very easily obtained by establishing the centerline of the base sill, installing sufficient clips along that line and impaling bottom sill sheet metal shape 40 on the clips. Shims or resilient sealing strip 36 bring base sill 40 into desired horizontal alignment. Prior to installation of the panels weep holes 38 may be drilled to provide drainage. The construction of this invention avoids the necessity, as presently encountered, of leveling the wall to the top of a concrete foundation. Utilizing the wall construction of this invention, the top of the foundation may be considerably out of level as long as suitable fastening for clips 30 is provided, such as foundation angle 20 as shown in FIG. 3.

Figure 4:
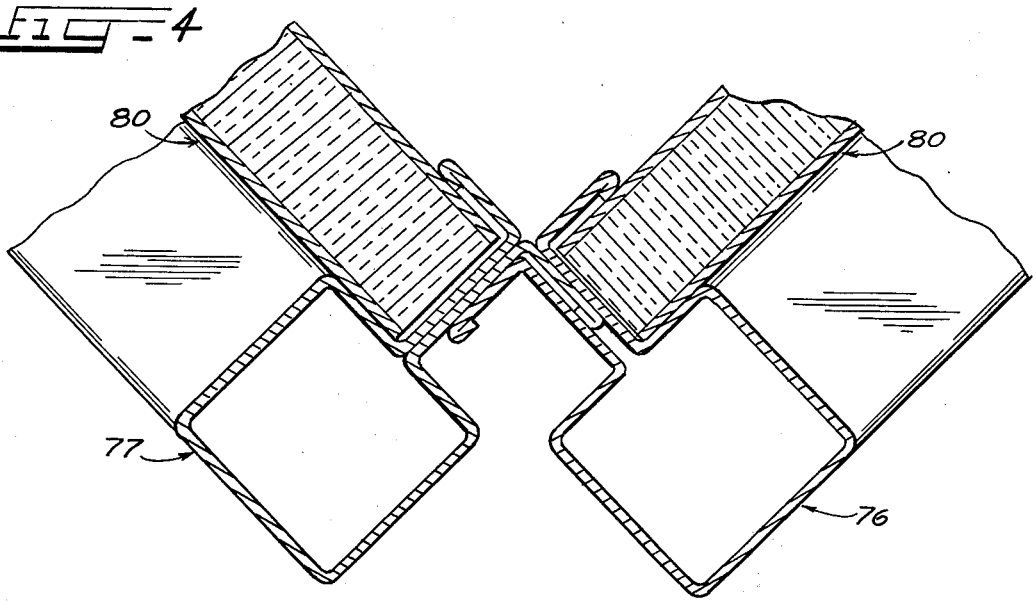
FIG. 4 is a cross section of a corner of the structure as indicated in FIG. 1.

FIG. 4 shows a corner cross-sectional detail of the structure as shown in FIG. 1 wherein one flange portion of mullion 77 is inserted between the opposing legs of mullion 76 which, together with locking action of panels 80 into the lower and upper sills, provides adequate rigidity to the corner structure. It is apparent that by simply bending the flange which is inserted in the slot between the opposing legs of the adjacent mullion, that any desired angle smaller than 90° between panels may be obtained. Angles of greater than 90° between panels may be obtained by bending one flange of each of the adjacent mullions until the box shaped section of the mullion interferes. Of course, the lower sill and upper cap are also adjusted to the desired angle to carry the corner structure. Using the corner structure as shown in FIG. 4, it is possible to make a closed cube without the use of fasteners.

Figure 7:
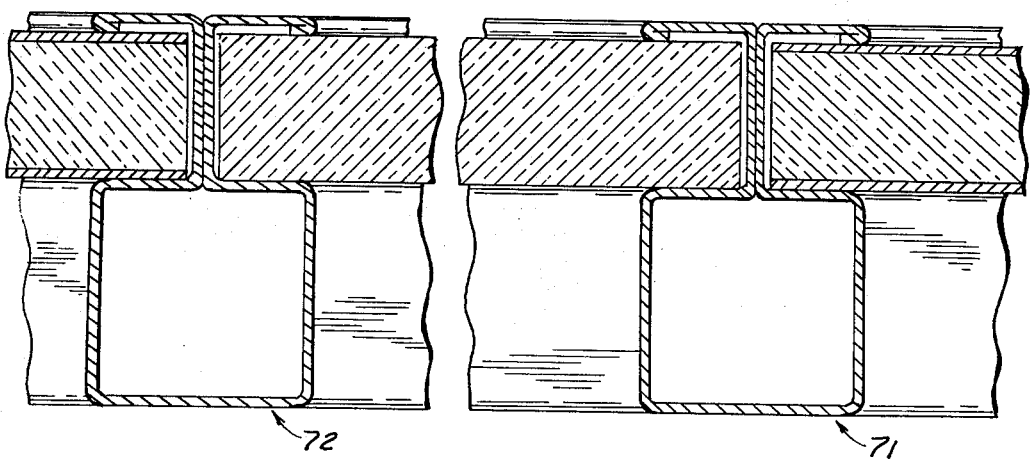
FIG. 7 is a cross-sectional view of the structure as indicated in FIG. 6.

After the lower sill structural shape such as 40 is attached to the structural portion of the building, three basic methods of construction may be utilized. A vertical mullion having the same shape as sheet metal structural shape 40 may be erected by simply placing it upon sheet metal shape 40 as shown in FIG. 3, and fastening it to structural steel frame 25 at the top by use of clips identical to clips 30. After the mullions have been so erected, the panels may be slid between adjacent mullions as shown in FIG. 7, from the top. When it is desired to use several panels to obtain the desired height, as shown in FIG. 1, the panels may very simply be sealed together by use of caulk strip 86 making sealed contact between panel edge 84 and panel edge 85. Caulk strip 85. Caulk strip 86 is most conveniently attached to panel edge 84 prior to its being inserted between the mullions from the top. Then, it is only necessary to insert one panel from the top and push it down until another panel can be received between the mullions and continuing this until the desired number of panels have been pushed into place, the lowermost panel locking the mullions into fixed relationship with bottom sill sheet metal shape 40 and the uppermost panel locking the mullions into fixed relationship with top cap 60 which is put into place after the panels have been installed. Thus, it is seen in each module of wall construction that the panels are locked into position by both the mullions and upper and lower sills in a fashion such that they will withstand wind loading from either side.

Another method of erection of the wall as shown in FIGS. 1–4 is to secure a first mullion in position at top and bottom and then place the panels in position from the side followed by placing the next adjacent mullion in position, thereby locking the module of panels and mullions in position. Utilizing this type of erection, it is necessary to fasten the top of mullions to the structural framework 25 at intervals sufficient to retain the wall in position during erection.

Another mode of erection of the wall structure of this invention is to preassemble as an assembly unit the necessary panel or panels to one mullion. The preassembly can be accomplished at a factory under controlled conditions and thereby considerably reduce field labor and serve to control quality of the wall contruction. As best seen in FIG. 3, the wall panels of the preassembled panel-mullion assembly protrude beyond the bottom and top of the mullion for a sufficient distance a fully engaged lower sill 40 and upper cap 60, respectively. The panel-mullion assembly is raised into position using a crane or other suitable hoisting equipment and lowered into place so that the protruding portion of the lower panel engages the slot of the lower sill 40 as shown in FIG. 3. If desired, the tops of the mullions may be secured to structural frame 25 as previously taught, utilizing the sheet metal clips.

Yet another mode of erection of the wall structure of this invention is to preassemble as an assembly unit a mullion on both sides of a panel or group of adjacent panels. The mullion-panel-mullion assemblies can be erected leaving spaces between adjacent assemblies to accommodate panels of desired width. Thus, the filler panels can be slid into the channels of the mullions from the top, locking the structure together.

Figure 6:
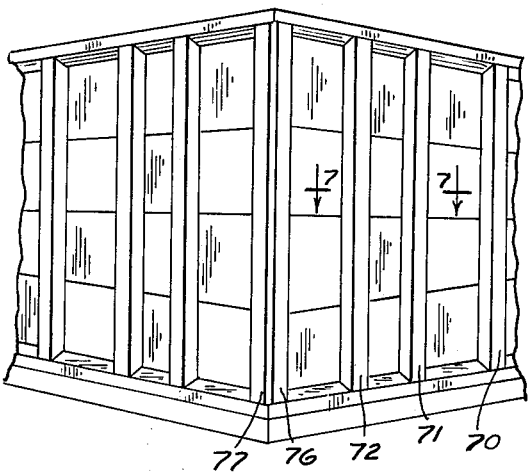
FIG. 6 is a corner perspective view of a similar structure as shown in FIG. 1 and having mullions of different spacings.

It is readily seen from the above description that great freedon is available with respect to mullion spacing which is principally governed by the type of panel used and the architectural effect desired. FIG. 6, for example, shows a perspective view of an exterior corner of a building similar to FIG. 1 except that the spaces between mullions 71 and 72 are considerably less than between mullion 70 and mullion 71. In fact, the spacings may be adjusted to accomodate desired building module requirements when standard panels available are not of suitable width. For example, if a 5½ ft. building module were desired, it could be obtained by a 4 ft. standard panel between mullions 70 and 71 and 1½ ft. panel between mullions 71 and 72. For example, to achieve desired architectural effects, the panels between mullions 70 and 71 might be metallic clad insulating panels while the panels between mullions 71 and 72 might be architectural glass, plastic, or other material. It is readily seen that the flexibility of spacing made possible through utilization of the wall construction of this invention opens new and boundless possibilities for achievement of dramatic architectural effects.

Although the above description has been with reference to panels placed between vertical mullions, the wall construction of this invention can be turned 90° and the alternating sheet metal structural shapes placed horizontally to form a horizontal panel wall system. It is readily apparent that the horizontal panel wall of this invention may be constructed in the same manner as described with respect to the vertical panel wall.

The flexibility of spacing offered by the wall construction of this invention also makes it easier to obtain desired wind loadings with specifically desired panels. For example, the panels may be cut in half and three mullions placed in the space that two mullions would normally be spaced to obtain higher wind loadings without any change in the basic structure nor in the structural frame.

FIG. 7 shows a cross section through a mullion-panel-mullion module of the wall as shown in FIG. 6. This is basically the same as the wall shown in FIGS. 1–4. The above described walls as shown are single panel thickness walls. The panels, such as 80 shown in FIG. 3, are conventional sandwich insulated core panels having a hard surface on both side 81 and side 83, frequently of metal, and an inner core 82 of insulating material, frequently foamed synthetic polymer such as polystyrene or polyurethane. The panels for use in the wall system previously described are of a thickness to suitably engage the grooves provided by the sheet metal box shapes such as 40. To facilitate such engagement, the edges of sandwich type panels may be slotted to permit the panels to be squeezed into the slots. It is apparent that any suitable wall panel may be utilized and panels that are too thin may be shimmed to firmly engage the slot of sheet metal structural shape 40 by use of appropriate filler strips and/or caulking material. As best seen in FIG. 7, a double panel wall may be obtained by alternate spacing of reversed mullions, that is, the box portions of the mullions being aligned side-by-side while the portion of the mullion for receiving the panel wall is on opposite sides. In a wall thus constructed, the panels are in contact with the back of the intermediate box portion of the adjacent mullion. For further spacing between a double wall, the mullions can be placed back-to-back. With appropriate upper cap and lower sill structural shapes as previously described, a double panel wall is readily obtained.

Figure 5:
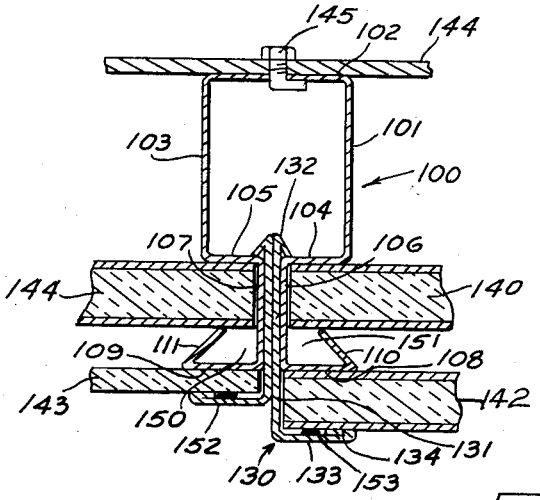
FIG. 5 is a cross-sectional view showing another embodiment of a roll formed sheet metal shape used in this invention showing adjacent panels of widely varying thickness and a separate insulating layer.

Referring to FIG. 5, a cross-sectional view of yet another embodiment of this invention is shown. Sheet metal section 100 shows a sheet metal structural box tee shape which functions in a similar manner as the sheet metal box tee shape described with respect to FIG. 3. However, the shape as shown in FIG. 5 is better adapted to being roll formed from heavier gauge metal and provides for larger and stiffer wall structures. The sheet metal structural shape is shown as having three adjacent box walls 101, 102 and 103, with the fourth box wall being split into two equal segments 104 and 105. From the ends of the split box walls 104 and 105 opposing legs 106 and 107 extend away from the box section at about 90° for a distance sufficient to accommodate the width of the desired panel, such as 140. At their outer ends, opposing legs 106 and 107 are bent to extend away from each other at approximately 90° forming flanges 108 annd 109, respectively. The ends of flanges 108 and 109 are turned inwardly to form an angle of less than 90°, preferably about 45° to 75° with the respective flanges to stiffen the edges of the flanges and to provide contact surface for the panels inserted between the ends of the turned back portions and the opposing split sides of the box section. A wall similar to that shown in FIGS. 1–4 may be constructed substituting the sheet metal structural shapes 100 for those shown, such as 40 in FIG. 3.

FIG. 5 shows another feature of this invention which is applicable to wall construction utilizing either the box shape shown as 40 in FIG. 3 or 100 as shown in FIG. 5. In this embodiment, panels are held adjacent the flanges of the sheet metal structural shape by clips which are shaped into firm engagement with the sheet metal shape by inserting a portion of the clip between the opposing legs of the structural shape. Panel clip 130 is shown in position securing panel 42. Panel clips 130 is made up of straight body portion 131 having locking end 132 at one end and clip leg 133 at the other end so that after erection of shape 100, panel 142 may be placed into position and clips 130 may be inserted between opposing legs 106 and 107 snapping firmly into position with clip leg 133 holding panel 142 adjacent flange 108 by locking end 132 clipping into position behind split box wall 104. If desired, caulking strip 153 may be inserted so as to lock into position between clip 133 and panel 142. Likewise, the end of clip leg 133 may be turned over as shown in FIG. 5, to form clip leg turn over 134 which provides spring action to panel clip 130. The panel clips are not continuous but are of suitable length and frequency to provide firm support for panel 142. The clips may be covered by a continuous plastic facing strip which snaps over clip leg 133. Such facing strips may be obtained in a wide variety of colors to achieve desired architectural appearance. In the embodiment shown in FIG. 5, the panel wall is to the exterior of the building from box section 100 which may be fastened to the structural framework of the building to serve as a bottom sill and top cap by fastening means such as 145. The wall of this embodiment may be erected in any of the erection methods described above if the panels are used in the slots of the shapes. When the slots are not used for carrying panels such as 140 and 144, the structural shapes are simply fastened to the building framework and the panels snapped into position with the clips.

It is seen from FIG. 5 that widely varying thicknesses of panels are readily accommodated by varying the length of body portion 131 of the panel clips. As seen in FIG. 5, panel 143 is much thinner than panel 142 while the only difference in the structure is the length of the body portion of the panel clips. Thus, a number of clips having different length body portions would provide for widely varying thicknesses of panels with intermediate differences being compensated for by caulk strips such as shown as 152 and 153. Insulating panels 140 and 144 may be used, if desired, but if not desired, the space may be left open.

The construction system as shown in FIG. 5 has a great advantage in that the individual panels 142 and 143 may be readily replaced if damaged by cutting clip 130 at the junction of the body portion and leg, removing the damaged panel and simply forcing clip 130 into the open box section of the structural shape. A new panel 142 may then be installed in place utilizing new panels clips 130. Likewise, the wall may be disassembled in the same fashion without damage to the panels which may then be reused. This feature permits easy expansion or contraction of the building structure with reutilization of the same materials, requiring only new panel clips.

Figure 8:
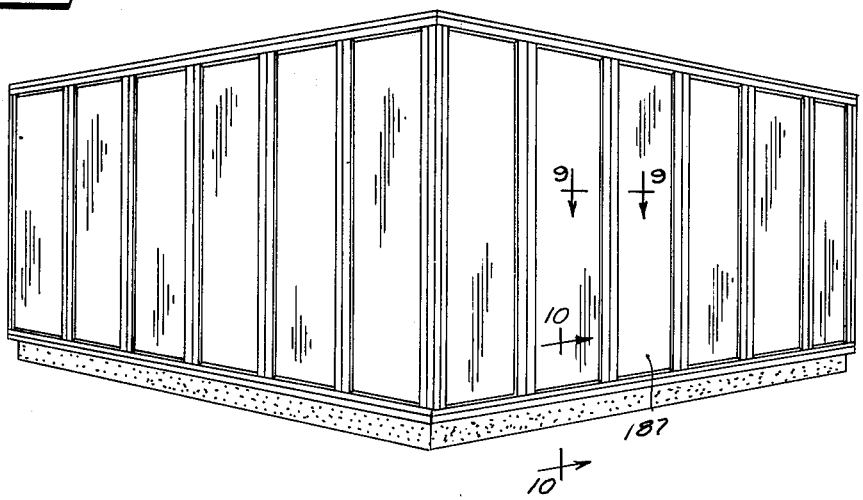
FIG. 8 is a perspective exterior corner view of another embodiment of this invention showing the use of single panels from the top to bottom of the structure.
Figure 9:
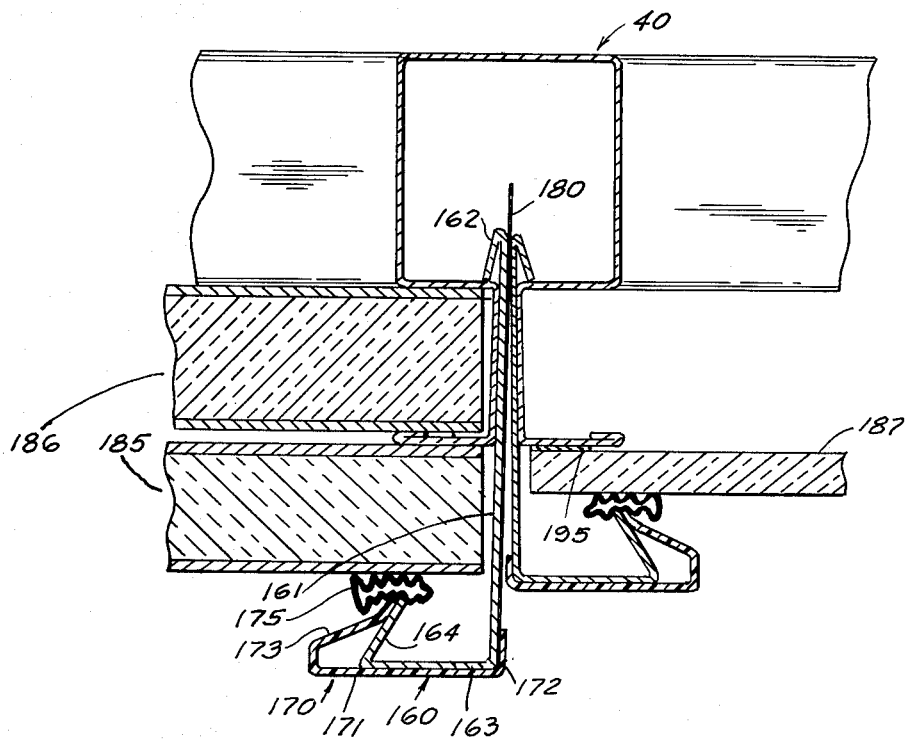
FIG. 9 is a cross-sectional view of a portion of the structure as indicated in FIG. 8 showing one embodiment of this invention through a window portion.
Figure 10:
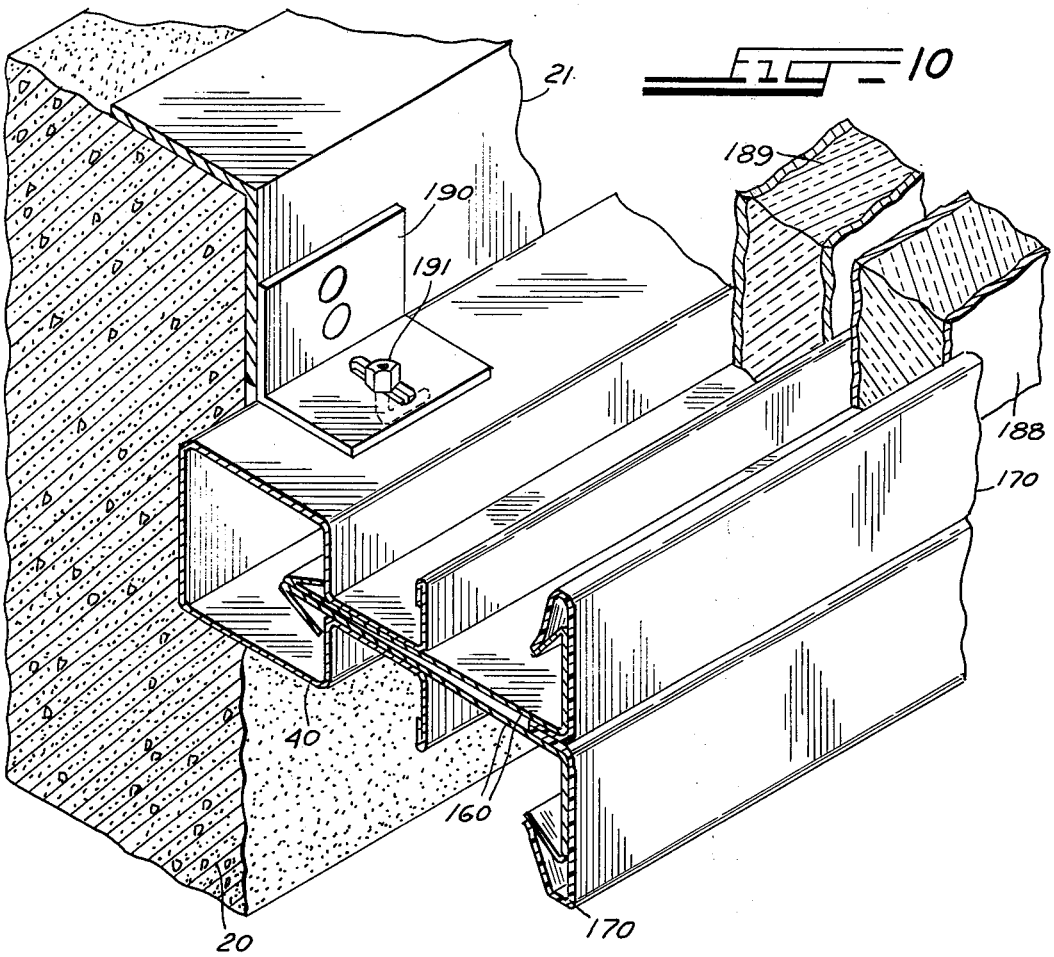
FIG. 10 is perspective cross-sectional view of the bottom sill of the structure as indicated in FIG. 8.

FIGS. 8, 9 and 10, show in perspective view, horizontal cross section and vertical cross section, respectively, a wall system similar to that described for FIG. 5 utilizing different sheet metal shapes and a different embodiment of the panel clip. As seen in FIG. 8, the mullion is exposed to the interior surface of the building as compared with FIG. 1 wherein the mullion is exposed to the exterior surface of the building. As shown in FIGS. 9 and 10, the structural shapes utilized in this embodiment are the same as used with respect to the wall structure shown in FIGS. 1–4.

The panel clip shown in this embodiment is best in FIG. 9 and is of the same general shape as the extending legs and flanges of the box section shown in FIG. 5. The panel clip has body section 161 with locking end 162, clip leg 163 at the other end of the body portion and the end of the clip leg turned up in portion 164 similar to flange end turnback 111, shown in FIG. 5. The action of clip 160 is the same as the clip 130 shown in FIG. 5. However, the clip leg turnback 164 is suitable for heavier gauge metal and provides a stiffer spring action against the panel 185. Wedge fastenings 175 may be inserted between panel clip leg portion 164 and panel 185 to assure tight fitting of the installed panel or caulk seal may be used.

Edge sheet 180, a continuous sheet of metal or plastic for the length of the panel is inserted adjacent panel clip 160 to cover the exposed end of panel 185, which is exposed between the intermittent clips 160. When edge sheet 180 is metal, it also acts as a flame stop as well as a closure.

Facing strip 170, a continuous strip for the length of panel 185 or butted evenly into end over a panel clip, extends the length of panel 185 and is snapped into position over edge sheet 180 and clip leg 164. The facing strip may desirably be fabricated from extruded plastic thus affording a weatherproof, resilient and permanently colored finished strip. Further, the designed of the plastic facing strip 170 permits easy and protected caulking between leg 173 and panel 185, if desired. The facing strip can also be attached to the flange of the sheet metal structural shape. When the facing strips butt one another, as when adjacent panels are of the same thickness, they may readily be solvent welded to prevent bowing or looseness.

As shown in FIG. 9, exterior panel 185 is an insulting sandwich-type panel having considerable thickness while the adjacent panel 187 is a glass window which is mounted with caulk strip 195.

FIG. 10 shows a section through the base sill of the wall construction as shown in FIG. 8 showing one embodiment of hanging the sheet metal box section sill 40 to the concrete foundation 20 utilizing hanger bracket 191. This system has all of the advantages as previously described with respect to the sill mounting system with respect to FIG. 3, that is the alignment of the top of the concrete foundation is not critical but may be adjusted by the hanger brackets 190. Otherwise, the holding of the wall panels is similar to that explained for FIG. 9 except, of course, there are no panels being held by the lower panel clips which provide additional support for the vertical loading of the panels and also provide fastening for the lower facing strip 170 to provide a neater sill appearance. The facing strip also serves as a drip channel. The bottom clip and facing as shown in FIG. 10 can be eliminated.

The walls utilizing panel clips as described may also be turned 90° to result in a horizontal panel wall system. Likewise, the walls may be erected with the box portion of the sheet metal structural shape on either side of the wall. The wall construction of this invention is suitable for exterior or interior walls. The wall construction of this invention provides an economical, easily erected structure which may be used for any type of building structure, particularly warehouses, utility buildings, and the like.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A panel wall construction of the type having alternating panels and panel carrying structural members comprising:

spaced sheet metal structural shapes of generally box-tee shape having three adjacent box walls, the fourth box wall being split into two segments, opposing legs extending away from the box section at about 90° from the ends of the split box walls for a distance to accommodate desired panels, the outer end of said legs extending away from each other forming flanges at about 90° to said legs and forming a channel to accept the edges of a wall panel;

lower sill sheet metal structural shape having the same design as said spaced shapes;

upper cap sheet metal structural shape having the same design as said spaced shapes;

said sill shape and cap shape aligned with said spaced shapes to accept a panel in said channel locking said spaced shapes, sill shape and cap shape into a rigid structure without separate fasteners;

panels in said channels of each adjacent said spaced structural shapes and adjacent sill shape and cap edge; and corner sheet metal structural shape assemblies comprising two of said sheet metal box-tee shapes having one flange of one shape inserted into the slot between opposing legs of the other box-tee shape.

2. The panel wall construction of claim 1 wherein said bottom sill is attached to a foundation frame by a clip fastener, said clip fastener having a body portion terminating in a locking end, said body portion extending through the slot between opposing legs of said lower sill sheet metal structural shape and said locking end extending into said box section holding said clip, the other end of said body portion having a clip leg at right angles to the body portion, said clip leg being secured to said foundation frame.

3. The panel wall construction of claim 1 wherein said spaced sheet metal structural shapes are in a vertical direction.

4. The panel wall construction of claim 1 wherein multiple panels are used in the vertical direction and the proximate edges of adjacent panels are inserted into opposing channels of a sheet metal structural shape of generally box-tee shape as defined by claim 1.

5. The panel wall construction of claim 1 wherein multiple panels are used vertically, adjacent panels sealed together by use of a caulk strip.

6. The panel wall construction of claim 1 wherein the end of each said flanges is turned inwardly back upon itself stiffening the edge of the flange providing smooth contact surface for the panels and imparting spring action to the flanges.

7. The panel wall construction of claim 1 wherein the end of each of said flanges are turned inwardly to form an angle of about 45° to 75° with the respective flanges.

8. A panel wall construction of the type having alternating panel and panel carrying structural members comprising:

spaced sheet metal structural shapes of generally box-tee shape having three adjacent box walls, the fourth box wall being split into two segments, opposing legs extending away from the box section at about 90° from the ends of the split box walls for a distance to accommodate desired panels, the outer end of said legs extending away from each other forming flanges at about 90° to said legs and forming a channel which may accept the edges of a wall panel;

lower sill sheet metal structural shape having the same design as said spaced shapes;

upper cap sheet metal structural shape having the same design as said spaced shapes;

said sill shape and cap shape aligned with said spaced shapes which may accept a panel in said channel locking said spaced shapes, sill shape and cap shape into a rigid structure without separate fasteners; and panels covering the space between the shapes, one surface of said panel abutting one of said legs of said shape, panel clips comprising a straight body portion having a locking end at one end and a clip leg at the other end so that said body portion may be inserted into the slot between opposing legs of said shape, the clip leg abutting the other surface of said panel and the locking end protruding into the hollow box portion of said shape locking the clip in position.

9. The panel wall construction of claim 8 wherein the end of said clip leg is turned inwardly back upon itself stiffening the edge of the clip providing smooth contact surface for the panels and imparting spring action to the clip.

10. The panel wall construction of claim 8 wherein the end of said clip leg is turned inwardly to form an angle of about 45° to 75° with the clip leg.

11. The panel wall construction of claim 8 wherein adjacent panels having differing thickness and held by clips having different length body portions.

12. The panel wall construction of claim 8 wherein a continuous facing strips snaps over the clip leg.

13. The panel wall construction of claim 8 additionally having panels in said channels forming a structure of two panel thicknesses.

14. The panel wall construction of claim 8 wherein a continuous sheet of metal or plastic is inserted for the length of the panel between a continuous facing strip and said clip extending alongside said clip body portion into the interior of said box section.

* * * * *